US008308528B2

(12) United States Patent
Ward

(10) Patent No.: US 8,308,528 B2
(45) **Date of Patent: *Nov. 13, 2012**

(54) APPARATUS AND METHOD FOR REDUCING REMOVAL FORCES FOR CMP PADS

(75) Inventor: Trent T. Ward, Kuna, ID (US)

(73) Assignee: Round Rock Research, LLC, Mt. Kisco, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/535,445

(22) Filed: Aug. 4, 2009

(65) Prior Publication Data

US 2009/0298395 A1 Dec. 3, 2009

Related U.S. Application Data

(63) Continuation of application No. 11/339,784, filed on Jan. 25, 2006, now Pat. No. 7,585,425, which is a continuation of application No. 10/852,547, filed on May 24, 2004, now Pat. No. 6,991,740, which is a continuation of application No. 10/160,528, filed on May 31, 2002, now Pat. No. 6,814,834, which is a continuation of application No. 09/478,692, filed on Jan. 6, 2000, now Pat. No. 6,398,905, which is a continuation of application No. 09/124,329, filed on Jul. 29, 1998, now Pat. No. 6,036,586.

(51) Int. Cl.
*B24B 1/00* (2006.01)

(52) U.S. Cl. ..... 451/41; 451/28; 451/60

(58) Field of Classification Search ..... 451/28, 451/41, 60

See application file for complete search history.

(56) References Cited

U.S. PATENT DOCUMENTS

| | | | | |
|---|---|---|---|---|
| 5,232,875 | A | | 8/1993 | Tuttle et al. |
| 5,302,233 | A | | 4/1994 | Kim et al. |
| 5,314,843 | A | | 5/1994 | Yu et al. |
| 5,434,107 | A | * | 7/1995 | Paranjpe ..... 438/760 |
| 5,533,924 | A | | 7/1996 | Stroupe et al. |
| 5,554,065 | A | | 9/1996 | Clover |
| 5,569,062 | A | | 10/1996 | Karlsrud |
| 5,575,707 | A | | 11/1996 | Talieh et al. |
| 5,618,381 | A | | 4/1997 | Doan et al. |
| 5,624,299 | A | * | 4/1997 | Shendon ..... 451/28 |
| 5,624,300 | A | | 4/1997 | Kishii et al. |
| 5,624,303 | A | | 4/1997 | Robinson |
| 5,624,304 | A | | 4/1997 | Rasch et al. |
| 5,639,697 | A | | 6/1997 | Weling et al. |
| 5,643,046 | A | | 7/1997 | Katakabe et al. |
| 5,643,050 | A | | 7/1997 | Chen |
| 5,643,406 | A | | 7/1997 | Shimomura et al. |

(Continued)

FOREIGN PATENT DOCUMENTS

EP 0683511 11/1995

*Primary Examiner* — Joseph J Hail
*Assistant Examiner* — Shantese McDonald
(74) *Attorney, Agent, or Firm* — Lerner, David, Littenberg, Krumholz & Mentlik, LLP

(57) ABSTRACT

An improvement in a polishing apparatus for planarizing substrates comprises a tenacious coating of a low-adhesion material to a platen surface. An expendable polishing pad is adhesively attached to the low-adhesion material, and may be removed for periodic replacement at much reduced expenditure of force. Polishing pads joined to low-adhesion materials such as polytetrafluoroethylene (PTFE) by conventional adhesives resist distortion during polishing but are readily removed for replacement.

17 Claims, 5 Drawing Sheets

U.S. PATENT DOCUMENTS

| | | | | |
|---|---|---|---|---|
| 5,643,837 | A | 7/1997 | Hayashi | |
| 5,743,788 | A * | 4/1998 | Vanell | 451/41 |
| 5,785,584 | A | 7/1998 | Marmillion et al. | |
| 5,945,347 | A | 8/1999 | Wright | |
| 6,036,586 | A | 3/2000 | Ward | |
| 6,398,905 | B1 | 6/2002 | Ward | |
| 6,814,834 | B2 | 11/2004 | Ward | |
| 6,991,740 | B2 | 1/2006 | Ward | |
| 7,775,785 | B2 * | 8/2010 | McCutcheon et al. | 425/405.1 |
| 2006/0118525 | A1 | 6/2006 | Ward | |

* cited by examiner

APPARATUS AND METHOD FOR REDUCING REMOVAL FORCES FOR CMP PADS

CROSS-REFERENCE TO RELATED APPLICATIONS

This application is a continuation of application Ser. No. 11/339,784, filed Jan. 25, 2006, now U.S. Pat. No. 7,585,425, issued Sep. 8, 2009, which is a continuation of application Ser. No. 10/852,547, filed May 24, 2004, now U.S. Pat. No. 6,991,740, issued Jan. 31, 2006, which is a continuation of application Ser. No. 10/160,528, filed May 31, 2002, now U.S. Pat. 6,814,834, issued Nov. 9, 2004, which is a continuation of application Ser. No. 09/478,692, filed Jan. 6, 2000, now U.S. Pat. 6,398,905, issued Jun. 4, 2002, which is a continuation of application Ser. No. 09/124,329, filed Jul. 29, 1998, now U.S. Pat. 6,036,586, issued Mar. 14, 2000. The disclosure of the previously referenced U.S. patent applications referenced is hereby incorporated by reference in its entirety.

BACKGROUND OF THE INVENTION

1. Field of the Invention:

This invention relates generally to polishing methods and apparatus. More particularly, the invention pertains to apparatus and methods for polishing and planarizing semiconductor wafers, optical lenses, and the like.

2. State of the Art

In the manufacture of semiconductor devices, it is important that the surface of a semiconductor wafer be planar.

For high density semiconductor devices having features with extremely small sizes, i.e., less than 1 μm, planarity of the semiconductor wafer is particularly critical to the photolithographic forming of the extremely small conductive traces, and the like.

Methods currently used for planarization include (a) reflow planarization, (b) application of a sacrificial dielectric followed by etch back planarization, (c) mechanical polishing and (d) chemical-mechanical polishing (CMP). Methods (a) through (c) have some applications but have disadvantages for global wafer planarization, particularly when fabricating dense, high speed devices.

In U.S. Pat. No. 5,434,107 to Paranjpe, a planarization method consists of applying an interlevel film of dielectric material to a wafer—and subjecting the wafer to heat and pressure so that the film flows and fills depressions in the wafer, producing a planar wafer surface. An ultraflat member overlying the dielectric material ensures that the latter forms a flat surface as it hardens. The ultraflat member has a non-stick surface such as polytetrafluoroethylene so that the interlevel film does not adhere thereto.

In a similar method shown in European Patent Publication No. 0 683 511 A2 to Prybyla et al. (AT&T Corp.), a wafer is covered with a hardenable low-viscosity polymer and an object with a highly planar surface is placed in contact with the polymer until the polymer is cured. The object is separated from the polymer, which has cured into a highly planar surface.

The planarization method of choice for fabrication of dense integrated circuits is typically chemical-mechanical polishing (CMP). This process comprises the abrasive polishing of the semiconductor wafer surface in the presence of a liquid or slurry.

In one form of CMP, a slurry of an abrasive material, usually combined with a chemical etchant at an acidic or alkaline pH, polishes the wafer surface in moving compressed planar contact with a relatively soft polishing pad or fabric. The combination of chemical and mechanical removal of material during polishing results in superior planarization of the polished surface. In this process it is important to remove sufficient material to provide a smooth surface, without removing an excessive quantity of underlying materials such as metal leads. It is also important to avoid the uneven removal of materials having different resistances to chemical etching and abrasion.

In an alternative CMP method, the polishing pad itself includes an abrasive material, and the added "slurry" may contain little or no abrasive material, but is chemically composed to provide the desired etching of the surface. This method is disclosed in U.S. Pat. No. 5,624,303 to Robinson, for example.

Various methods for improving wafer planarity are directed toward the application of interlayer materials of various hardness on the wafer surface prior to polishing. Such methods are illustrated in U.S. Pat. No. 5,618,381 to Doan et al., U.S. Pat. No. 5,639,697 to Weling et al., U.S. Pat. No. 5,302,233 to Kim et al., U.S. Pat. No. 5,643,837 to Hayashi, and U.S. Pat. No. 5,314,843 to Yu et al.

The typical apparatus for CMP polishing of a wafer comprises a frame or base on which a rotatable polishing pad holder or platen is mounted. The platen, for example, may be about 20 inches to 48 inches (about 50 cm. to 122 cm.) or more in diameter. A polishing pad is typically joined to the platen surface with a pressure-sensitive adhesive (PSA).

One or more rotatable substrate carriers are configured to compress, e.g., semiconductor wafers against the polishing pad. The substrate carrier may include non-stick portions to ensure that the substrate, e.g., wafer, is released after the polishing step. Such is shown in U.S. Pat. No. 5,434,107 to Paranjpe and U.S. Pat. No. 5,533,924 to Stroupe et al.

The relative motion, whether circular, orbital or vibratory, of the polishing pad and substrate in an abrasive/etching slurry may provide a high degree of planarity without scratching or gouging of the substrate surface, depending upon wafer surface conditions. Variations in CMP apparatus are shown in U.S. Pat. No. 5,232,875 to Tuttle et al., U.S. Pat. No. 5,575,707 to Talieh et al., U.S. Pat. No. 5,624,299 to Shendon, U.S. Pat. No. 5,624,300 to Kishii et al., U.S. Pat. No. 5,643,046 to Katakabe et al., U.S. Pat. No. 5,643,050 to Chen, and U.S. Pat. No. 5,643,406 to Shimomura et al.

In U.S. Pat. No. 5,575,707 to Talieh et al., a wafer polishing system has a plurality of small polishing pads which together are used to polish a semiconductor wafer.

As shown in U.S. Pat. No. 5,624,304 to Pasch et al., the polishing pad may be formed in several layers, and a circumferential lip may be used to retain a desired depth of slurry on the polishing surface.

A CMP polishing pad has one or more layers and may comprise, for example, felt fiber fabric impregnated with blown polyurethane. Other materials may be used to form suitable polishing pads. In general, the polishing pad is configured as a compromise polishing pad—that is a pad having sufficient rigidity to provide the desired planarity, and sufficient resilience to obtain the desired continuous tactile pressure between the pad and the substrate as the substrate thickness decreases during the polishing process.

Polishing pads are subjected to stress forces in directions both parallel to and normal to the pad-substrate interfacial surface. In addition, pad deterioration may occur because of the harsh chemical environment. Thus, the adhesion strength of the polishing pad to the platen must be adequate to resist the applied multidirectional forces during polishing, and chemical deterioration should not be so great that the pad-to-platen adhesion fails before the pad itself is in need of replacement.

Pores or depressions in pads typically become filled with abrasive materials during the polishing process. The resulting "glaze" may cause gouging of the surface being polished. Attempts to devise apparatus and "pad conditioning" methods for removing such "glaze" materials are illustrated in U.S. Pat. No. 5,569,062 to Karlsrud and U.S. Pat. No. 5,554,065 to Clover.

In any case, polishing pads are expendable, having a limited life and requiring replacement on a regular basis, even in a system with pad conditioning apparatus. For example, the working life of a typical widely used CMP polishing pad is about 20 hours to 30 hours.

Replacement of polishing pads is a difficult procedure. The pad must be manually pulled from the platen, overcoming the tenacity of the adhesive which is used. The force required to manually remove a 30-inch diameter pad from a bare aluminum or ceramic platen may exceed 100 lbf (444.8 Newtons) and may be as high as 150 lbf (667.2 Newtons) or higher. Manually applying such high forces may result in personal injury as well as damage to the platen and attached machinery.

BRIEF SUMMARY OF THE INVENTION

The embodiments described herein comprise the application of a permanent, low adhesion, i.e., "non-stick," coating of uniform thickness to the platen surface. Examples of such coating materials are fluorinated compounds, in particular, fluoropolymers including polytetrafluoroethylene (PTFE) sold under the trademark TEFLON® by DuPont, as well as polymonochlorotrifluoroethylene (CTFE) and polyvinylidene fluoride ($PVF_2$). The coating retains its tenacity to the underlying platen material, and its relatively low adhesion to other materials, at the temperatures, mechanical forces, and chemical action encountered in CMP processes.

BRIEF DESCRIPTION OF THE SEVERAL VIEWS OF THE DRAWINGS

The invention is illustrated in the following figures, wherein the elements are not necessarily shown to scale.

DETAILED DESCRIPTION OF THE INVENTION

Figure 1:
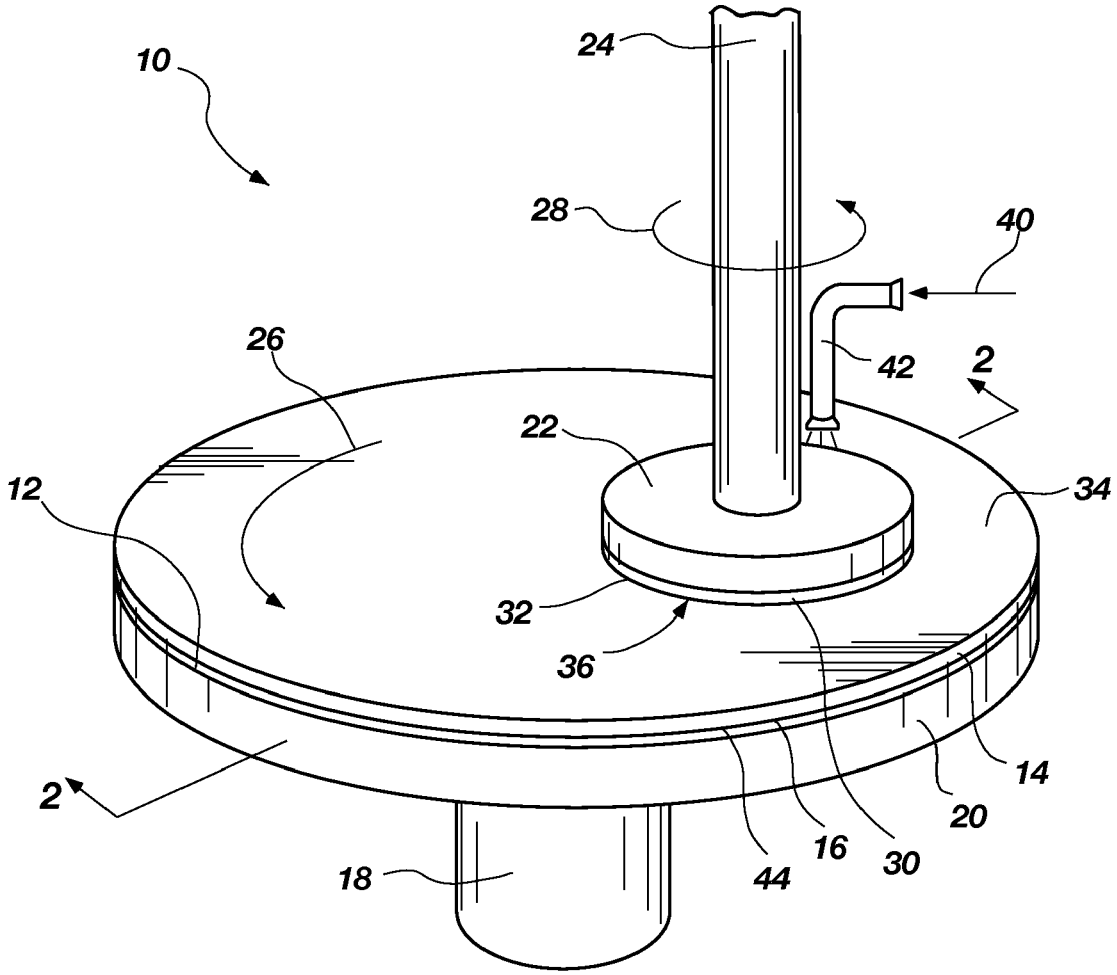
Fig. 1 (PRIOR ART)
FIG. 1 is a perspective partial view of a polishing apparatus of the prior art.
Figure 2:
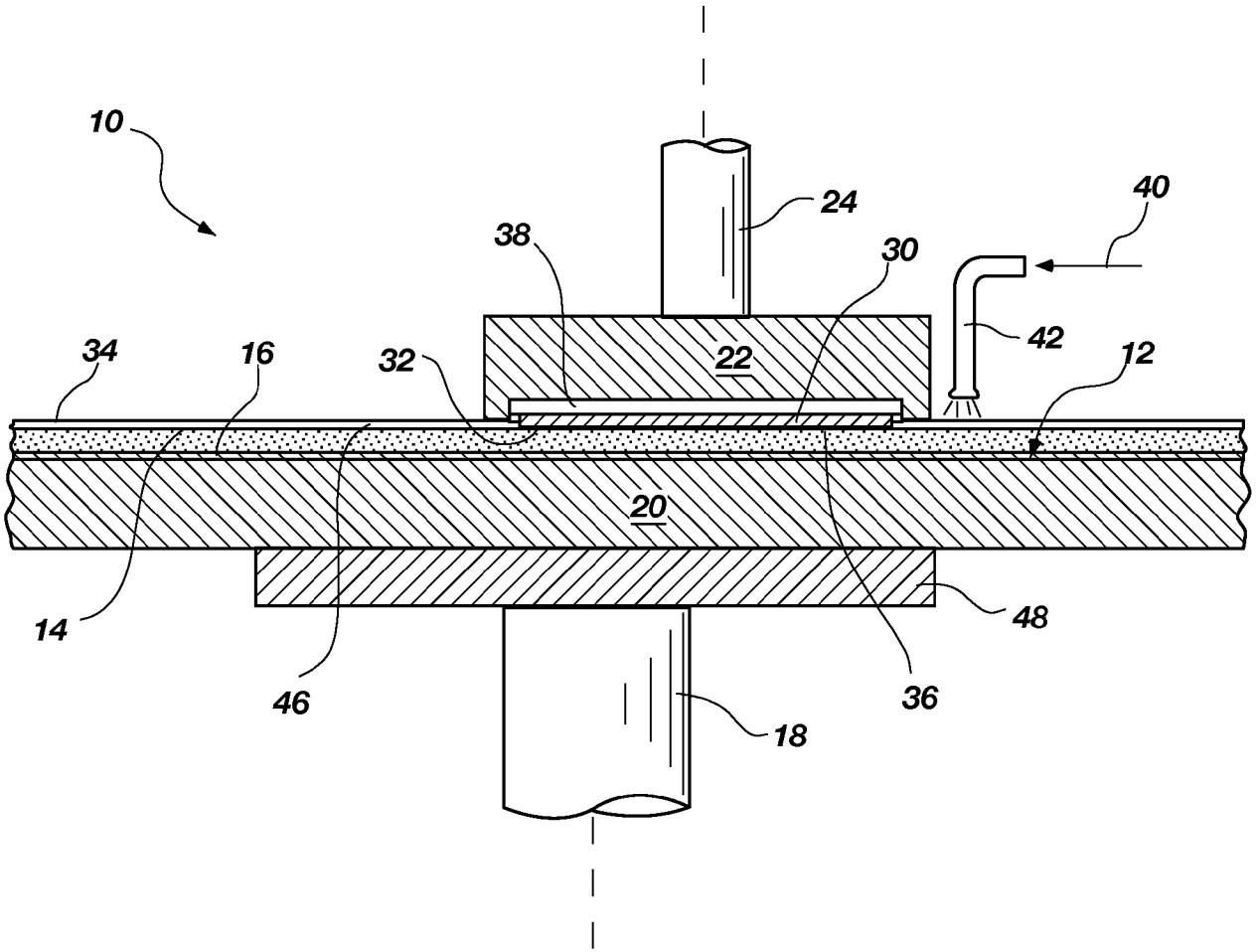
Fig. 2 (PRIOR ART)
FIG. 2 is a cross-sectional view of a portion of a polishing apparatus of the prior art, as taken along section line 2-2 of FIG. 1.

Portions of a typical prior art chemical-mechanical polishing (CMP) machine 10 are illustrated in drawing FIGS. 1 and 2. A platen 20 has attached to its upper surface 12 a polishing pad 14 by a layer of adhesive 16. If it is desired to rotate platen 20, its shaft 18, attached to the platen 20 by flange 48, may be turned by a drive mechanism, such as a motor and gear arrangement, not shown.

A substrate 30 such as a semiconductor wafer or optical lens is mounted on a substrate carrier 22 which may be configured to be moved in a rotational, orbital and/or vibratory motion by motive means, not shown, through shaft 24. In a simple system, shafts 18 and 24 may be rotated in directions 26 and 28 as shown. The substrate 30 is held in the substrate carrier 22 by friction, vacuum or other means resulting in quick release following the polishing step. A layer 38 of resilient material may lie between the substrate 30 and substrate carrier 22. The surface 32 of the substrate 30 which is to be planarized faces a pad polishing surface 34 of the polishing pad 14 and is compressed thereagainst under generally light pressure during relative movement of the platen 20 (and polishing pad 14).

In chemical-mechanical polishing (CMP), a polishing slurry 40 is introduced to the substrate-pad interface 36 to assist in the polishing, cool the interfacial area, and help maintain a uniform rate of material removal from the substrate 30. The slurry 40 may be introduced, e.g., via tube 42 from above, or may be upwardly introduced through apertures, not shown, in the polishing pad 14. Typically, the slurry 40 flows as a layer 46 on the pad polishing surface 34 and overflows to be discarded.

Upward removal of a polishing pad 14 from the upper surface 12 of the platen 20 is generally a difficult operation requiring high removal forces. Pad replacement is necessary on a regular basis, and the invention described herein and illustrated in drawing FIGS. 3 through 6 makes pad replacement easier, safer and faster.

Figure 3:
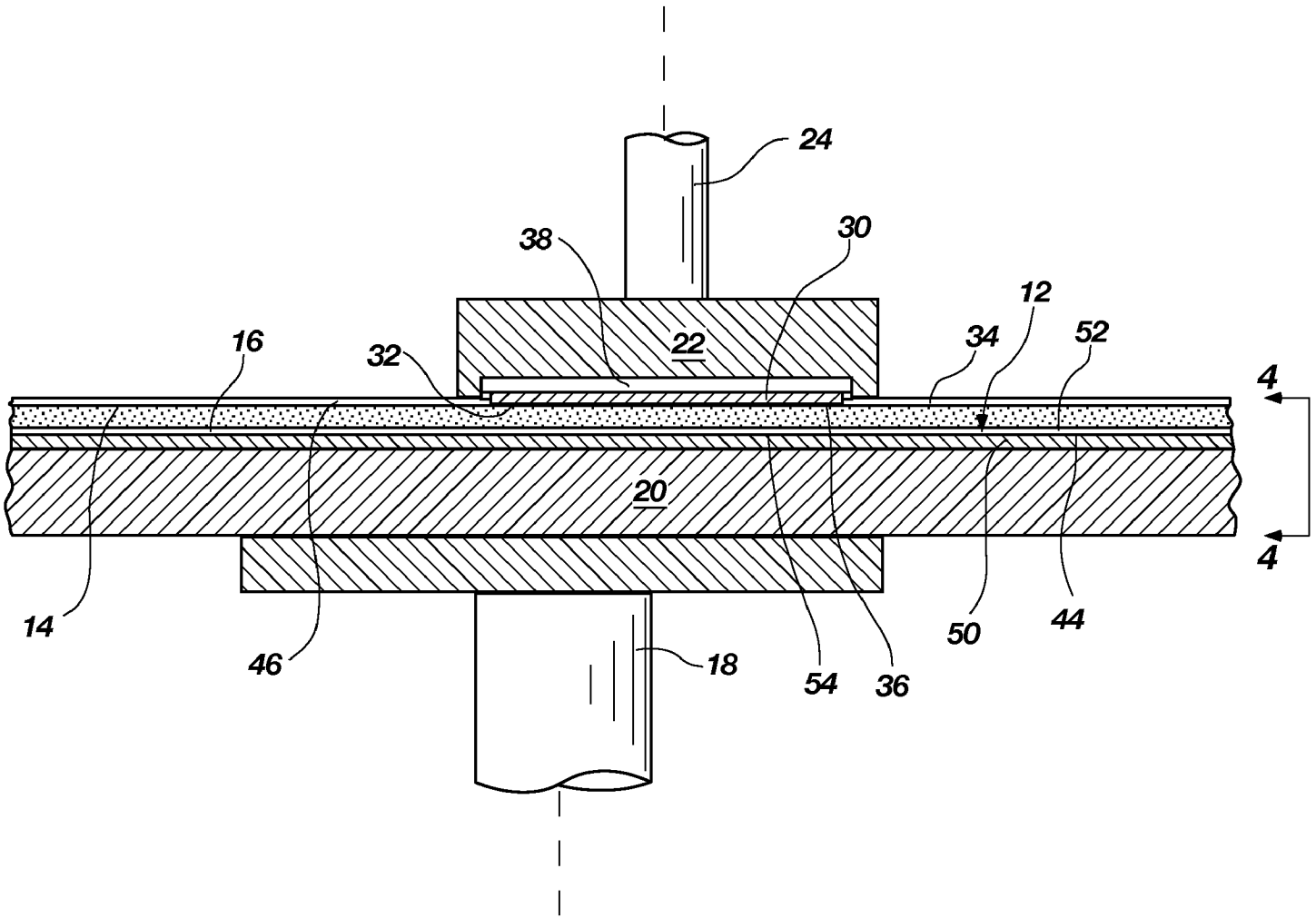
FIG. 3 is a cross-sectional view of a portion of a polishing apparatus of the invention.
Figure 4:
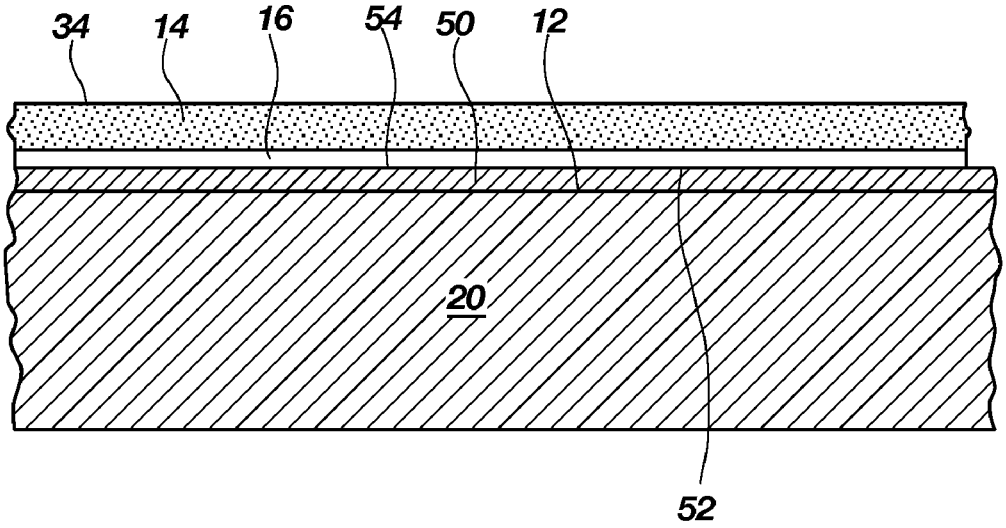
FIG. 4 is a cross-sectional view of a portion of a platen and polishing pad of the invention, as taken along section line 4-4 of FIG. 3.

Turning now to drawing FIGS. 3 and 4, the prior art polishing apparatus of drawing FIG. 2 is shown with a platen 20 modified in accordance with the invention. Parts are numbered as in drawing FIG. 2, with the modification comprising a permanent coating 50 of a "non-stick" or low-adhesion material applied to the upper surface 12 of the platen 20, along coating/adhesive interface 54. The polishing pad 14 is then attached to the coating 50 using a pressure-sensitive adhesive (PSA) 16. It is common practice for manufacturers of polishing pads to supply pads with a high-adhesion PSA already fixed to the attachment surface 44 (FIG. 1) of the pads. It has been found that the adhesion of polishing pads 14 to certain low-adhesion coatings 50 with conventional high-adhesion adhesives results in a lower release force, yet the bond strength is sufficient to maintain the integrity of the polishing pads 14 during the polishing operations. Typically, variables affecting the release force include the type and surface smoothness of the coating 50, the type and specific adhesion characteristics of the adhesive 16 material, and pad size.

Figure 6:
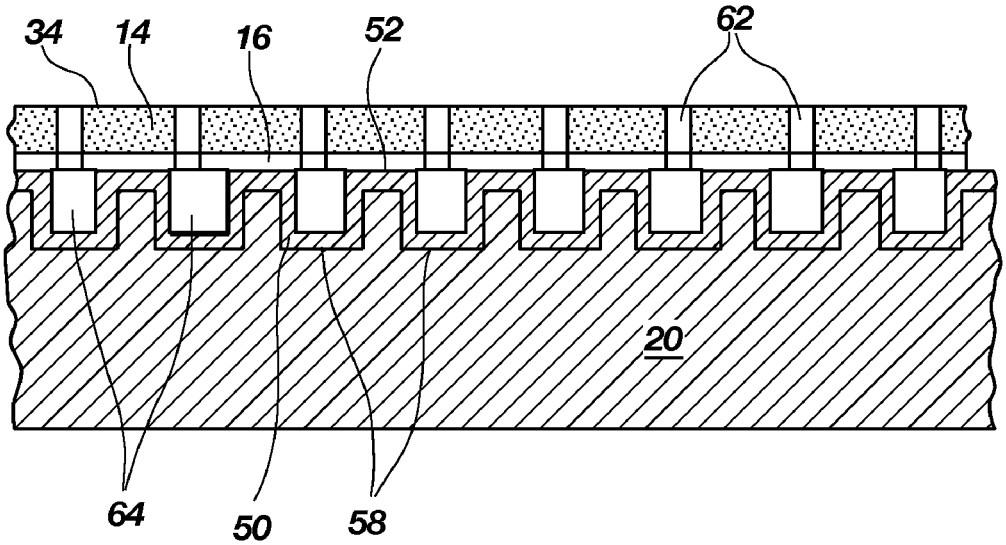
FIG. 6 is a cross-sectional view of a portion of a platen and polishing pad of the invention, as taken along section line 6-6 of FIG. 5.
Figure 5:
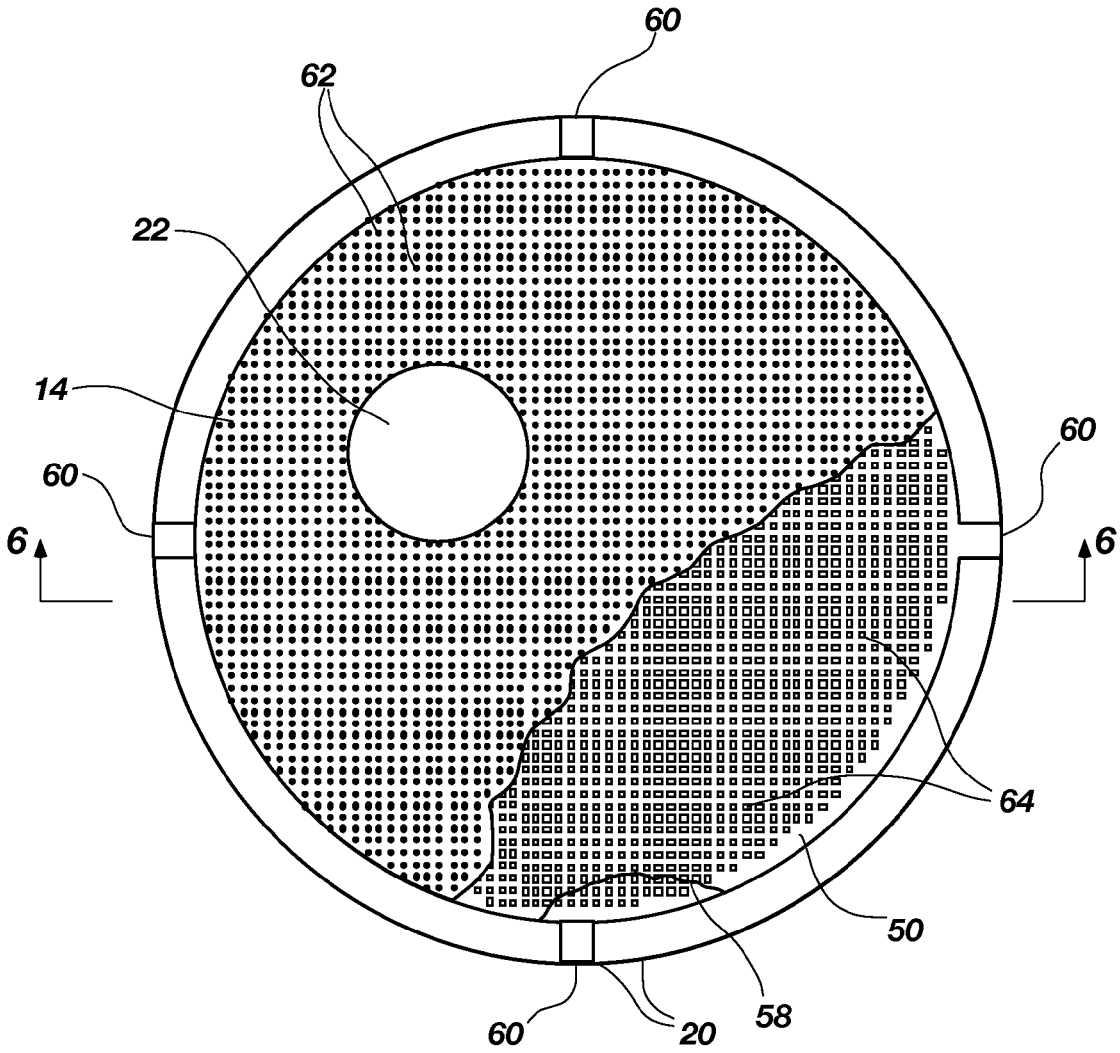
FIG. 5 is a top view of a polishing platen and pad of another embodiment of the invention.

Referring to drawing FIGS. 5 and 6, depicted is another version of the platen 20 which is coated with a low-adhesion coating 50 in accordance with the invention. In this embodiment, the platen 20 includes a network of channels 58, and slurry 40 (not shown) is fed thereto through conduits 60. The low-adhesion coating 50 covers the platen 20 and, as shown, may extend into at least the upper portions of channels 58. Apertures 64 through the coating 50 match the network of channels 58 in the platen 20. The polishing pad 14 and attached pressure-sensitive adhesive (PSA) 16 have through-apertures 62 through which the slurry 40 may flow upward from the network of channels 58 and onto the polishing surface 34 of the polishing pad 14.

The surface area of coating 50 to which the adhesive 16 may adhere is reduced by the apertures 64. This loss of contact area between pressure-sensitive adhesive (PSA) 16 and coating 50 of platen 20 may be compensated by changing the surface smoothness of the coating 50 or using an adhesive material with a higher release force.

Materials which have been found useful for coating the platen 20 include coatings based on fluoropolymers, including polytetrafluoroethylene (PTFE or "TEFLON®") polymonochloro-trifluoroethylene (CTFE) and polyvinylidene fluoride ($PVF_2$). Other materials may be used to coat the upper surface 12 of platen 20, provided that the material has the desired adherence, i.e., release properties, with available adhesives, may be readily cleaned, and has a long life in the mechanical and chemical environment of polishing.

Various coating methods may be used. The platen 20 may be coated, for example, using any of the various viable commercial processes, including conventional and electrostatic spraying, hot melt spraying, and cementation.

In the application of one coating process to a modification of the platen 20, the upper surface 12 of the platen 20 is first roughened to enhance adhesion. The coating material 50 is then applied to the upper surface 12 by a wet spraying or dry powder technique, as known in the art. In one variation of the coating process, white-hot metal particles, not shown, are first sprayed onto the uncoated base surface and permitted to cool, and the coating 50 is then applied. The metal particles reinforce the coating 50 of low-adhesion material which is applied to the platen 20.

The result of this invention is a substantial reduction in release force between polishing pad 14 and platen 20 to a level at which the polishing pad 14 may be removed from the platen 20 with minimal effort, yet the planar attachment of the polishing pad 14 to the platen 20 during polishing operations will not be compromised. The particular combination(s) of coating 50 and adhesive 16 material which provide the desired release force may be determined by testing various adhesive formulations with different coatings.

Another method for controlling the release force is the introduction of a controlled degree of "roughness" in the coating surfaces 52 (including surfaces of fluorocarbon materials) for changing the coefficient of friction. The adhesion of an adhesive 16 material to a coating 50 may be thus controlled, irrespective of the pad construction, size or composition.

The use of a coating 50 of the invention provides useful advantages in any process where a polishing pad 14 must be periodically removed from a platen 20. Thus, use of the coating 50 is commercially applicable to any polishing method, whether chemical-mechanical polishing (CMP), chemical polishing (CP) or mechanical polishing (MP), where a polishing pad 14 of any kind is attached to a platen 20.

EXAMPLE

A piece of flat aluminum coated with polytetrafluoroethylene (PTFE) was procured. The particular formulation of PTFE applied to the aluminum was MALYNCO 35011 BLACK TEFLON™.

Conventional CMP polishing pad samples were obtained in a size of 3.7 ×4.2 inches (9.4 ×10.67 cm.). The area of each pad was 15.54 square inches (100.3 square cm.). These pads were identified as SUBA IV (PSA 2) adhesive pads and were obtained from Rodel Products Corporation of Scottsdale, Ariz.

The polishing pads included a polyurethane-based pressure-sensitive adhesive (PSA 2) on one surface. The pads were placed on the coated aluminum, baked at 53° C. for two hours under slight compression, and cooled for a minimum of 45 minutes, thereby bonding the pads to the PTFE surface.

Samples of the same pad material were similarly adhered to an uncoated aluminum surface of a polishing platen for comparison as test controls.

Tests were conducted to determine the force required to remove each pad from the surface coating and the uncoated surfaces. The average measured removal forces were as follows:

Removal force from MALYNCO 35011 BLACK TEFLON™ coated aluminum: 1.08 lbf.

Removal force from uncoated aluminum: 11.5 lbf.

Extrapolation to actual production size platens of 30-inch diameter indicates that pad removal forces may be reduced from about 100 to 150 lbf. (about 444.8 to 667.2 Newtons) to about 15 lbf. to about 25 lbf. (about 66 to 112 Newtons). This force is sufficient to maintain pad-to-platen integrity during long-term polishing but is a significant reduction in the force required for pad removal and replacement.

It is apparent to those skilled in the art that various changes and modifications, including variations in pad type and size, platen type and size, pad removal procedure, etc., may be made to the polishing apparatus and method of the invention as described herein without departing from the spirit and scope of the invention as defined in the following claims.

What is claimed is:

1. A method for attaching a polishing pad to a platen, wherein the platen comprises an upper surface, at least a portion of the upper surface being coated with a coating of a fluoropolymer material, the method comprising:

adhesively attaching the polishing pad to the coating of the upper surface of the platen using an adhesive material.

2. The method of claim 1, wherein the upper surface has an aperture therein, wherein at least a portion of the aperture is free of attachment to the polishing pad.

3. The method of claim 1, wherein the coating of the fluoropolymer material is selected from the group consisting of polytetrafluoroethylene (PTFE), polymonochlorotrifluoroethylene (CTFE) and polyvinylidene fluoride ($PVF_2$).

4. The method of claim 1, wherein the upper surface includes a network of channels for slurry flow formed therein.

5. A method of attaching a polishing pad to a platen for polishing wafers, wherein the platen comprises an upper surface, at least a portion of the upper surface being coated with a coating of a fluoropolymer material, the method comprising:

attaching the polishing pad directly to the coating using an adhesive material.

6. The method of claim 5, wherein the platen is configured to rotate about an axis normal to a first surface of a rigid member.

7. The method of claim 5, wherein the adhesive material is a pressure-sensitive adhesive material.

8. The method of claim 5, wherein the upper surface is configured for use in a chemical-mechanical polishing process using the polishing pad.

9. A method of attaching a polishing pad to a platen for polishing wafers, the method comprising:

coating a fluoropolymer material on at least a portion of a first surface of the platen; and adhesively attaching a polishing pad to the coating of fluoropolymer material, the coating of fluoropolymer material comprising a roughened fluoropolymer coating enhancing adhesion between the coating of fluoropolymer material and a pressure-sensitive adhesive material by directly attaching the polishing pad to the coating of fluoropolymer material on the at least a portion of the first surface of the platen.

10. A wafer polishing method, comprising:

adhesively attaching a polishing pad directly to a platen, the platen including a coating of a fluoropolymer material on at least a portion of a first surface thereof, by adhesively attaching the polishing pad directly to the coating of the fluoropolymer material on the at least a portion of the first surface of the platen; and contacting a surface of the wafer with a portion of the polishing pad.

11. The method of claim 10, further comprising:

contacting an attachment surface of the polishing pad and the coating of the fluoropolymer material on the at least a portion of the first surface of the platen with a pressure-sensitive adhesive material for adhesively attaching the polishing pad directly to the coating of the fluoropolymer material on the at least a portion of the first surface of the platen.

12. A platen for a polishing apparatus for polishing wafers, comprising:

a platen including a coating of a fluoropolymer material directly coated on at least a portion of a first surface of the platen for directly adhesively attaching a polishing pad to at least a portion of the coating of the fluoropolymer material on the at least a portion of the first surface of the platen for a polishing process for the wafers.

13. The platen of claim 12, wherein the platen has a substantially planar first surface thereof configured for use in a chemical-mechanical polishing process using the polishing pad directly adhesively attached to at least a portion of the coating of the fluoropolymer material.

14. The platen of claim 12, wherein a substantially planar first surface of the platen includes a network of channels therein for passage of a slurry therethrough, and wherein the coating of fluoropolymer material on the substantially planar first surface of the platen being configured for direct adhesive attachment of the polishing pad having through-apertures for discharge of the slurry onto a polishing surface.

15. A polishing apparatus for planarizing a substrate, the polishing apparatus comprising:

a polishing pad including a polishing surface;

a platen having a first surface including a coating of low-adhesion material thereon for adhesive attachment of at least a portion of the polishing pad directly thereto;

a substrate carrier for holding a substrate against the polishing surface of the polishing pad; and moving apparatus for moving the platen and substrate carrier relative to each other for polishing a portion of the substrate.

16. The polishing apparatus of claim 15, wherein the coating of low-adhesion material is selected from the group consisting of polytetrafluoro-ethylene (TFE), polymonochlorotrifluoroethylene (CTFE) and polyvinylidene fluoride ($PVF_2$).

17. The polishing apparatus of claim 15, further comprising:

a pressure sensitive adhesive material joining the polishing pad to the coating of low-adhesion material on the platen.

* * * * *